United States Patent [19]

Sneed, Jr. et al.

[11] 4,388,601

[45] Jun. 14, 1983

[54] SYMMETRIZING MEANS FOR RF COILS IN A MICROWAVE CAVITY

[75] Inventors: Robert C. Sneed, Jr., Campbell; Robert G. MacNaughton, Cupertino; James H. Jacobsen, Palo Alto, all of Calif.

[73] Assignee: Varian Associates, Inc., Palo Alto, Calif.

[21] Appl. No.: 307,144

[22] Filed: Sep. 30, 1981

[51] Int. Cl.[3] ..... H01P 7/06; H01P 5/00

[52] U.S. Cl. ..... 333/227; 324/318; 333/231

[58] Field of Search ..... 333/219–235, 333/245, 248; 324/307–310, 318–321

[56] References Cited

U.S. PATENT DOCUMENTS 3,419,794 12/1968 Weaver, Jr. et al. ..... 324/319

*Primary Examiner*—Marvin L. Nussbaum

*Attorney, Agent, or Firm*—Stanley Z. Cole; Edward H. Berkowitz

[57] ABSTRACT

A cylindrical ENDOR cavity with RF saddle coils disposed axially is symmetrized by shielding the end portions of the saddle coil within cylindrical conducting rings or cylinder portions whereby the Q of the cavity is substantially enhanced.

10 Claims, 4 Drawing Figures

SYMMETRIZING MEANS FOR RF COILS IN A MICROWAVE CAVITY

DESCRIPTION

BACKGROUND OF THE INVENTION

The present invention is in the field of RF resonance spectroscopy and in particular relates to the microwave cavity structure for electron nuclear double resonance spectrometry.

Electron double resonance (ENDOR) is the phenomenon wherein nuclear resonance of sample nuclei is attained concurrently with the electron paramagnetic resonance condition for unpaired electrons of the sample material. The resonance conditions are attained in a common DC polarizing magnetic field. The sample resides within a microwave cavity, resonant at the microwave frequency for electron paramagnetic resonance (EPR) and adapted to provide the rotating RF fields requisite for nuclear magnetic resonance (NMR). Although the RF and microwave channels are in principle instrumentally independent, the ENDOR cavity imposes limitations on performance of an equivalent conventional cavity due to the presence of an RF coil. This is an extremely critical component for an ENDOR spectrometer which must sustain resonant microwave magnetic fields orthogonal to the polarizing DC magnetic field and at the same time, without degradation of the microwave cavity performance, also contain an RF coil or loop to produce the rotating RF field for the nuclear resonance.

It is an important consideration of ENDOR cavity design that the cavity Q be minimally affected by the presence of the RF loop. One prior art cavity resonant in the $TE_{01n}$ mode comprised a cylinder with four rods symmetrically disposed in the interior of, and at a fixed radius from the cavity axis and parallel with the cavity axis. The sample was inserted on the axis and the surrounding rods connected external to the cavity to form a pair of one-turn coils for the RF irradiation of the surrounded sample. This approach consequently required an excessively large current to produce the desired RF field intensity. The rods forming the coil, being connected external to the cavity, result in a portion of the RF energy coupled directly to the cavity closure plates through which the rods pass. This prior art cavity has been employed in equipment such as the Varian E-1700 ENDOR Spectrometer and has been described in "Multiple Electron Resonance Spectroscopy", Dorio and Freed (eds.), Plenum Press, 1979, Chptr. 2.

Another prior art ENDOR cavity operating in the $TM_{110}$ mode features a cylindrical cavity with coaxial helical RF coil wound on a quartz capillary to contain the sample. Hollow metal cylinders coaxially disposed external of cavity provide mounting means for the helix. An example of this art is described in J. Chem. Phys., Vol. 61, pp. 4334–4341.

BRIEF DESCRIPTION OF THE INVENTION

It is an object of the present invention to combine with a microwave cavity an RF coil with minimum resulting reduction in the Q of the cavity.

In one feature of the invention, a pair of saddle coils is disposed within a cylindrically symmetric microwave resonant cavity about an axially aligned sample holding tube, the saddle coils comprising portions parallel to the axis and portions transverse to the axis, and electrically conductive ring structures insulated from said coils and disposed coaxially about each said transverse portion of the saddle coils, whereby cylindrical symmetry is preserved within the cavity.

In another feature of the invention, the axial length of the saddle coils are such that the transverse portions of said saddle coils occupy regions of substantially zero microwave electric field.

In another feature of the invention, the cavity is cylindrical of first radius and has planar end surfaces and cylindrical cavity extensions protruding outwardly from said end walls within which extensions said transverse portions of the RF coil are disposed.

In another feature of the invention, the cavity is cylindrical of first radius and has planar end walls and further comprises coaxial cylindrical inward protruding cavity extensions from said end walls within which extensions said transverse portions of the RF saddle coil are disposed.

These features are accomplished by providing symmetrizing structures which electrically shield the cross connections of the saddle coils and portions thereof transverse to the cavity axis from the cavity interior. The symmetrizing means takes the form in one embodiment of a conductive ring situated over the cross connection of the saddle coils, or in other embodiments, the coaxial sleeves which project outwardly or inwardly from the end closures of the cavity.

DETAILED DESCRIPTION OF THE INVENTION

Figure 1:
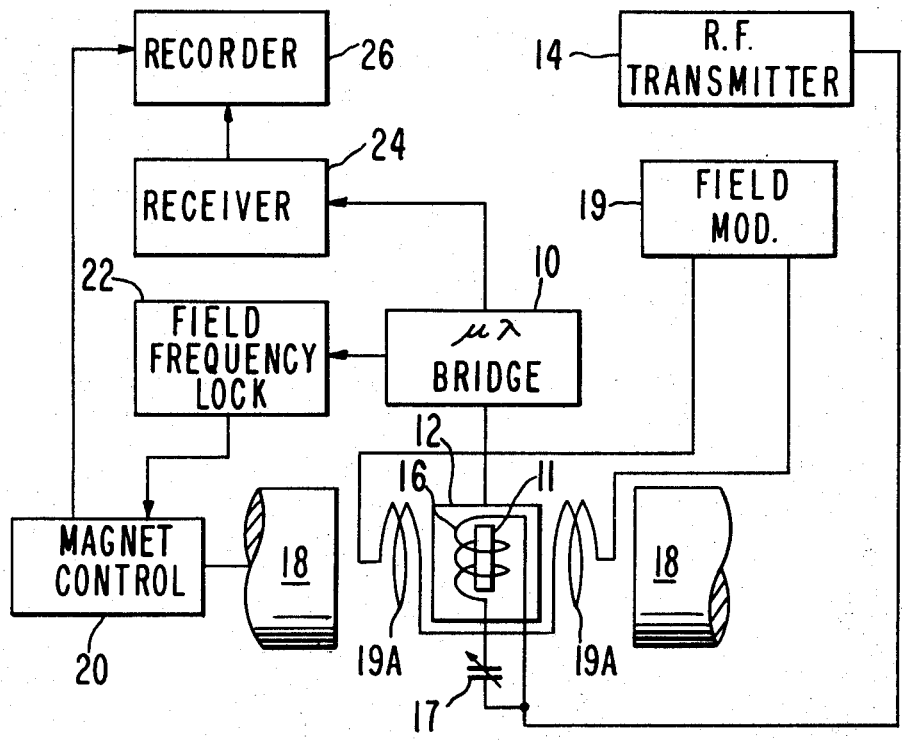
FIG. 1 shows the context of the present invention.

A schematicized description of an ENDOR spectrometer is illustrated in FIG. 1 wherein a microwave bridge 10 containing a microwave source excites the cavity 12 and bridge 10 further measures the microwave energy absorbed by sample 11 within the cavity 12. An RF transmitter 14 excites the RF coils 16 disposed within the cavity and surrounding the sample as part of a circuit 17 which may be series resonant, parallel resonant or non-resonant. The cavity 12 is disposed in a polarizing magnetic field of magnet 18 with provision for field modulation apparatus 19 and modulation coils 19A, and the field is controlled from appropriate control apparatus 20. The latter frequently employs a field frequency lock 22 to maintain field stability by reference to a known resonance. A receiver 24 operative upon the output of bridge 10 demodulates the bridge signal for output to a recording device 26. Various modes of operation are discussed in the references cited above.

Figure 2:
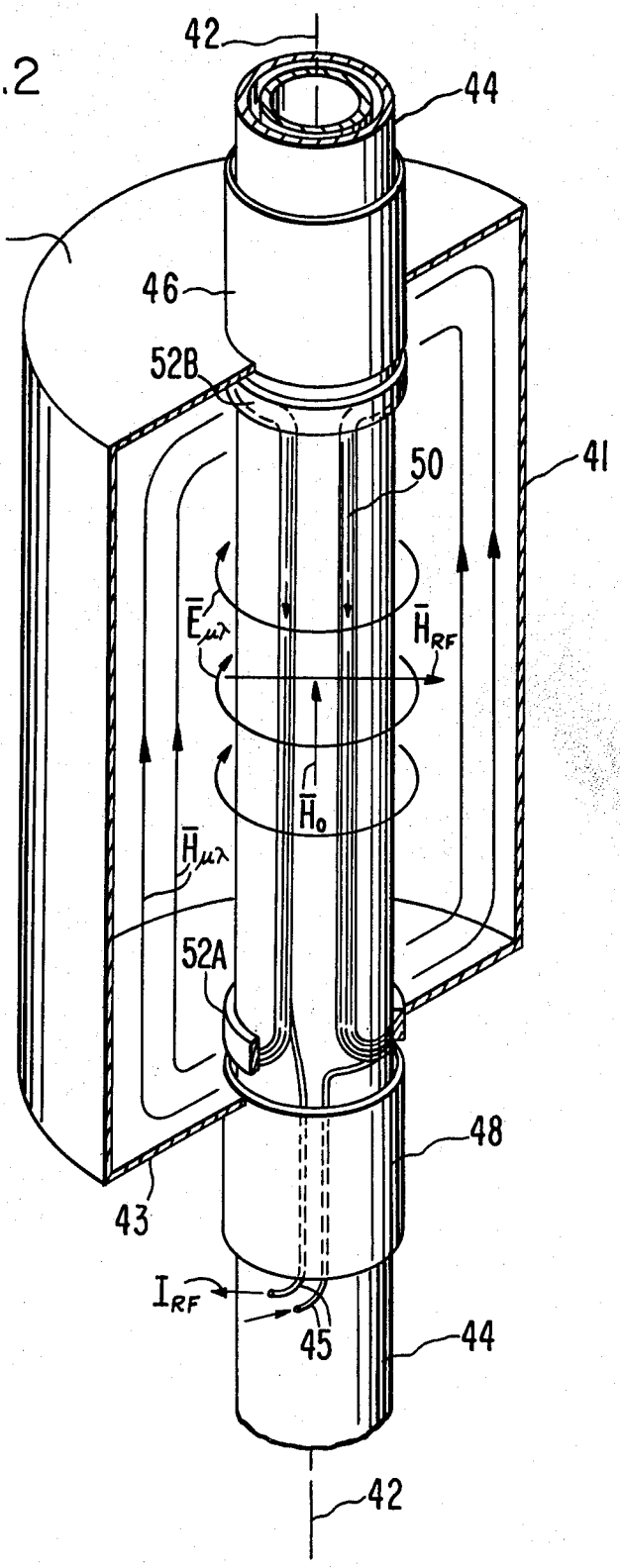
FIG. 2 illustrates one embodiment of the invention.

The present invention is best understood with the aid of FIG. 2 wherein the ENDOR cavity 40 comprises a cylindrical resonant microwave cavity 41. Cavity 41 is characterized by highly conducting walls of materials such as silver, aluminum or copper. A sample space region on the axis 42 of the cavity 41 is occupied by a sample holder 44 which preferably takes the form of a quartz dewar. End plates 43 complete the closure of the cavity. The sample holder 44 is maintained in radial position and supported by cylindrical metal stack sleeves 46 and 48 fitted to apertures in the end closure plates 43. Axial motion of the dewar is inhibited by mechanical means (not shown) to secure the sample and coil at the desired axial position.

The cavity 41 is preferentially excited in the $TE_{011}$ mode. The microwave electric and magnetic field distributions are represented schematically by $E_{\mu\lambda}$ and $H_{\mu\lambda}$. From the boundary conditions operative in this geometry it is noted that the magnitude of $E_{\mu\lambda}$ vanishes for the extreme values of the axial and radial coordinates.

Disposed internally of the cavity 41 are the RF coils 50. These are formed as saddle coils having a long dimension parallel to the axis of cavity 41 and a short dimension situated substantially transverse to the cavity axis. The latter portions are curved to conform to the cylindrical sample holder 44. Saddle coils 50 are wound in such form that the individual coil terminal leads 45 are brought out tangentially from the coils near a selected junction of the long and transverse winding portions for excitation by a current $I_{RF}$. The preferred saddle coils are discussed more fully in U.S. Ser. No. 230,226 commonly assigned with the present invention. The direction of the polarizing magnetic field $H_0$ is orthogonal to the common axis 42 of the coils 50 and cavity 41.

It is apparent that departure from cylindrical symmetry is thereby localized to the end regions of the coil/cavity. It has been found in the present work that addition of electrically conducting ring structures surrounding these end regions restores symmetry to the electromagnetic environment. Accordingly, symmetrizing rings 52A and 52B are disposed around the transverse portion of the saddle coil 50, electrically insulated therefrom. The plane of the symmetrizing rings 52A and 52B are positioned to coincide with equipotential planes of nearly zero microwave electric fields and therefor are virtually noninteracting with the microwave field itself. The restoration of cylindrical symmetry of the microwave resonant space is found to increase the quality factor Q of the cavity. In one example, an empty cylindrical cavity (silver coils, without stacks) has a length 2.725" and a diameter of 1.60". The theoretical loaded Q for this idealized cavity is determined to be 9500. A real cavity of identical dimensions equipped with quartz dewar, stacks and RF coil without symmetrizing rings exhibits a measured loaded Q of 1954. With the addition of symmetrizing rings after the fashion of 52A and 52B, the measured loaded Q was found to be 3322.

Figure 3:
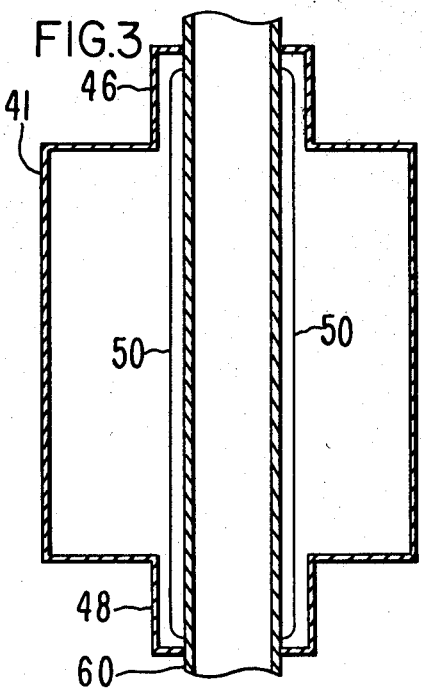
FIG. 3 illustrates another embodiment of the invention.

Another embodiment is illustrated in FIG. 3 where there is shown a section of an ENDOR cavity which differs from the cavity of FIG. 2 in that provision of quartz tube 60 receives the sample dewar (not shown) and provides a stationary form for the saddle coils 50. It is preferred, although nonessential, for the RF saddle coils 50 to be disposed on the inner surface of quartz tube 60 in order to maximize the RF excitation in the sample. The corresponding components shown in FIG. 3 are numbered to correspond with the counterpart components of FIG. 2. In the embodiment of FIG. 3 the cross connection between the saddle coil windings 50 occurs in the region enclosed by the stacks 46 and 48 and separate symmetrizing rings (52A and 52B of FIG. 2) are unnecessary to achieve electrical symmetry in the interior of the cavity. With this embodiment the location of the RF windings is fixed, unlike the embodiment of FIG. 2 where the RF windings and symmetrizing rings are located on the surface of the dewar and are removed or inserted with the sample dewar.

Figure 4:
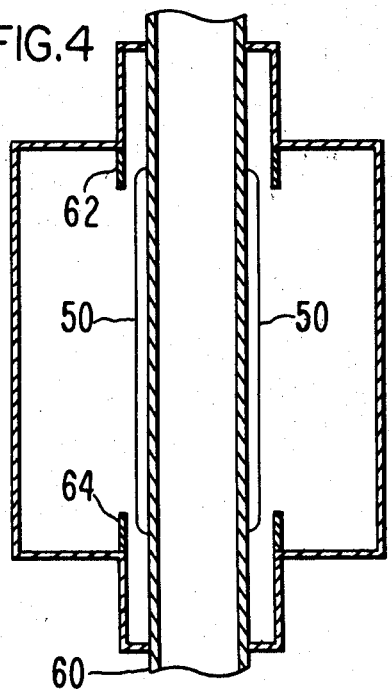
FIG. 4 illustrates still another embodiment of the invention.

A third embodiment is shown in FIG. 4 where again corresponding components are labeled in common with FIGS. 2 and 3. The symmetrizing sleeves 62 and 64 are thin conducting cylinders protruding from the interior end walls of the cavity. In this preferred embodiment, RF saddle coils 50 may now occupy a shorter axial dimension thereby reducing the inductance without significantly affecting the Q of the cavity.

While the invention has been particularly shown and described with reference to particular embodiments thereof, it will be understood by those skilled in the art that the foregoing and other changes in form and details may be made therein without departing from the spirit and scope of the invention.

What is claimed is:

1. A microwave resonant cavity for sustaining a desired distribution of microwave vector magnetic and electric field and an RF coil structure disposed within said cavity, said coil comprising first portions orthogonal to the direction of said microwave magnetic field and second portions substantially conformal with the direction of said microwave magnetic field and electrically conducting symmetrizing means disposed about said second portions of said RF coil, said symmetrizing means substantially conformal with said microwave electric field direction in the neighborhood of said second portions.

2. The apparatus of claim 1 wherein said cavity is cylindrical with planar end closure plates and the microwave electric field is distributed in a $TE_{01n}$ mode.

3. The apparatus of claim 2 wherein said end planar closure plates are apertured to receive cylindrical sample holder means on the axis of said cavity.

4. The apparatus of claim 3 wherein said sample holder means comprises RF saddle coils conforming to a surface of said sample holder means, said RF saddle coil means having first portions parallel to the axis of said cavity and second portions substantially transverse to the axis of said cavity.

5. The apparatus of claim 4 wherein said second portions of said RF saddle coil are located in proximity to the planar end surfaces of said cavity in the interior thereof.

6. The apparatus of claim 5 wherein said symmetrizing means comprise electrically conducting cylindrical portions mounted about said second portions of said RF saddle coil and insulated therefrom.

7. The apparatus of claim 5 wherein said symmetrizing means comprise a coaxial cylindrical body protruding inwardly of said cavity from each said planar end closure plates, and spaced from said second portions of said RF coil means.

8. The apparatus of claim 4 wherein said second portions of said RF saddle coils are located in proximity to the planar end closure plates of said cavity and external thereto.

9. The apparatus of claim 8 wherein said symmetrizing means comprise a coaxial cylindrical body protruding outwardly of said cavity from each said planar end closure plates and spaced apart from said second RF saddle coil portions.

10. A cylindrical resonant microwave cavity having planar end closures and apertures therein, each said end closure aperture on the axis of the cavity, a stack sleeve, comprising a cylindrical conducting member affixed to said end closure, coaxial therewith and surrounding said apertures, a sample holder comprising a cylindrical member coaxial with said cavity for containing a sample, and an RF saddle coil comprising a pair of windings, each said winding comprising portions parallel to the axis of said cavity and portions transverse to said parallel portions, and said saddle coils conformed to a portion of the outer surface of said sample holder, symmetrizing means comprising conducting rings surrounding said transverse winding portions of said saddle coils and said symmetrizing means not in electrical contact therewith, each said symmetrizing means disposed to occupy a region of substantially zero RF electrical field.

* * * * *